US006070548A

United States Patent [19]

Ducousso et al.

[11] Patent Number: 6,070,548

[45] Date of Patent: Jun. 6, 2000

[54] VESSEL HAVING QUICK DISCONNECT MEANS, AND DISCONNECT MEANS FOR USE IN SUCH A VESSEL

[75] Inventors: Patrick Ducousso, Folian; Jean-Loup Isnard, Vence; René Perratone, Menton, all of France

[73] Assignee: Single Buoy Moorings Inc., Marly, Switzerland

[21] Appl. No.: 08/934,735

[22] Filed: Sep. 22, 1997

[30] Foreign Application Priority Data

Sep. 20, 1996 [EP] European Pat. Off. ..... 96202633

[51] Int. Cl.[7] ..... B63B 21/52

[52] U.S. Cl. ..... 114/293; 114/230.12

[58] Field of Search ..... 114/199, 200, 114/230.12, 293, 221 R, 210; 441/3–5; 24/116 R

[56] References Cited

U.S. PATENT DOCUMENTS

| | | | |
|---|---|---|---|
| 1,912,366 | 6/1933 | Hausenfluck | 114/210 |
| 2,652,018 | 9/1953 | Griffith . | |
| 3,365,734 | 1/1968 | Petrie et al. | 114/200 |
| 3,557,737 | 1/1971 | Smulders | 114/200 |
| 3,799,097 | 3/1974 | Robertson . | |
| 3,805,728 | 4/1974 | Abraham | 114/210 |
| 4,367,982 | 1/1983 | Hubbard | 114/199 |
| 5,381,750 | 1/1995 | Pollack | 114/230.12 |

FOREIGN PATENT DOCUMENTS

| | | |
|---|---|---|
| 373561 | 5/1907 | France . |
| 81278 | 4/1956 | Netherlands . |
| 1114538 | 5/1968 | United Kingdom . |
| 2077839 | 12/1981 | United Kingdom . |
| WO 94/18065 | 8/1994 | WIPO . |

*Primary Examiner*—Ed Swinehart
*Attorney, Agent, or Firm*—Young & Thompson

[57] ABSTRACT

A vessel comprising at least one anchor line (15). Disconnect elements are attached to the anchor line for releasing the vessel from the sea bed. A first part of the disconnect element (16) is directly attached to the vessel and a second part is attached to the anchor line (17). Upon detaching the anchor lines from the vessel, no cables will protrude from underneath the vessel after disconnecting. Thereby the risk of interference of the anchor lines with the vessel itself, with other vessels or with objects on the seabed in shallow waters is avoided. Furthermore, the disconnect elements can be directly controlled from the vessel. Inspection and maintenance can be easily performed. Preferably, the vessel comprises two or more anchor lines, each anchor line having a disconnect element which can be independently operated. Thereby a staged release of the anchor lines is possible which may be adapted to weather conditions or approaching objects such as icebergs.

7 Claims, 3 Drawing Sheets

VESSEL HAVING QUICK DISCONNECT MEANS, AND DISCONNECT MEANS FOR USE IN SUCH A VESSEL

FIELD OF THE INVENTION

The invention relates to a vessel comprising at least one anchor line for connecting the vessel to a sea bed and disconnect means releasably attaching the anchor line to the vessel.

BACKGROUND OF THE INVENTION

In the offshore technology, floating production, storage and offloading vessels, drilling rigs or barges, are often anchored to the seabed by means of catenary anchor lines or anchor chains. From a subsea structure, such as an oil well, flexible risers may be attached to the vessel or to the rig, for instance via a turret around which the vessel or rig can weathervane. In case of emergencies or high seas and strong winds, the known disconnect means can be actuated by means of a radio signal from the vessel, acoustically or electrically through a cable connection, such that for instance an hydraulic actuating mechanism detaches the first and second halves of the disconnect means. Rig anchor release units of the above type are for instance available from InterOcean systems inc, San Diego.

The known disconnect means have as a disadvantage that they are located relatively far below the water surface, such that they cannot be easily inspected for maintenance purposes. Furthermore, after disconnecting the parts of the disconnect means, the part that is attached to the vessel by an anchor line may cause problems in shallow waters or may interfere with risers around the drilling well or other objects on the sea bed.

SUMMARY OF THE INVENTION

It is an object of the present invention to provide a vessel with a quick disconnect means which can be actuated in a rapid and reliable manner, which can be easily inspected and which can be easily actuated. It is a further object of the invention, to provide a vessel which can be disconnected from its anchor lines in a controlled manner.

Thereto a vessel according to the present invention is characterized in that the disconnect means comprises a first part attached to the vessel and a second part attached to the anchor line.

By placing the disconnect means directly on the vessel, instead of at some distance along the anchor lines, no cables will protrude from underneath the vessel after disconnecting. Thereby the risk of interference of the anchor lines with the vessel itself, with other vessels, or with objects on the seabed in shallow waters, is avoided. Furthermore, the disconnect means according to the invention can be directly controlled from the vessel by means of a cable connection, such as by a hydraulic or electrical control signal or by mechanical control. Also can inspection and maintenance be easily performed. This is of particular importance when the vessel is operated in for instance arctic waters.

Preferably the first part comprises a hollow housing which is attached to the vessel near keel level, the second part comprising a plug which is attached to the anchor line and which can be inserted into the housing, the plug being on an external surface provided with first coupling means for engaging second coupling means on an internal coupling surface of the housing, the distance between the first coupling means and the second coupling means being variable, wherein the housing at its side facing the vessel, is provided with an opening via which the anchor line passes into the vessel.

One embodiment of a vessel according to the invention is characterized in that each anchor line or group of anchor lines comprises a respective, independently operatable disconnect means.

By being able to release each anchor line, or group of anchor lines, independently, it is possible to detach the vessel from the sea floor in stages. This allows the vessel position to be optimized in case of high seas or during storm conditions. A staged release of the anchor lines is also important in case an object, such as an iceberg, is observed which may collide with the vessel. At a first distance of the object from the vessel, a number of anchor lines may be disconnected as a precaution. When the object approaches further, the anchor lines are released successively until the vessel is able to move out of the path of the object.

It is noted that from U.S. Pat. No. 4,604,961 a mooring buoy is known which can be releasibly attached to a tanker for hydrocarbons. The buoy is attached to the seabed by a number of catenary mooring lines. A flexible riser is connected to the mooring buoy. When the mooring buoy is released from the vessel, the anchor lines are all disconnected at once. Also is the riser disconnected when the mooring buoy is released. No controlled release of the anchor lines is possible. Furthermore, the anchor lines terminate at the mooring buoy, and do not enter into the vessel via the disconnect means such that the tension on the anchor chains cannot be adjusted, for instance by a winch on the vessel. The term "anchor lines" as used herein is intended to comprise anchor cables, ropes or chains.

The term "vessel" as used herein is intended to comprise floating structures, such a tankers, barges, rigs, weathervaning structures, mooring buoys etc.

The disconnect means according to the invention can be applied to a large number of different vessels that can be moored to many different types of mooring structures. The disconnect means can be used on weathervaning vessels, on stationary rigs, in a single anchor line mooring, in spread moorings, for mooring a vessel directly to the sea bed, to a mooring buoy, to a subsea structure, and the like.

Preferably, the disconnect means are hingingly attached to the vessel, such that the disconnect means can follow the movement of the vessel with respect to the anchor lines, and the stress on the disconnect means remains low.

In an embodiment of the vessel according to the invention, the vessel comprises a turret well extending from a deck level of the vessel to a keel level below the water line. A rotatable turret is mounted in said turret well. The first part of the disconnect means is connected to the turret near keel level. The vessel is connected to a subsea structure via a conduit that is disconnectably attached to the turret. The release means of the anchor lines can be actuated independently from the connection of the conduit. Hereby the flow of hydrocarbons to the vessel can be maintained, while one or more anchor lines are disconnected. It is also possible to flush the conduit, and subsequently release the conduit from the vessel while the vessel remains attached to the anchor lines.

In another embodiment of a vessel according to the invention, the disconnect means comprise a hollow sleeve attached to the vessel. The anchor line is connected near the vessel to a plug member which on an external surface is provided with projections or indentations engaging with coupling means on an internal coupling surface of the sleeve.

The plug member may be hollow such that the anchor lines can pass through the plug member to a winch on the vessel. Hereby the anchor lines can be tightened, for instance after a period of settling. When the anchor lines are formed by chains, the hollow plug member preferably comprises a chain stopper.

The plug member may also be solid and form the end part of the anchor lines. An embodiment of such a plug member comprises a conical front part having a locking shoulder and a lower positioning edge. The housing comprises at least one locking pawl, preferably four locking pawls, which is engageable with the locking shoulder of the plug member, and a receiving rim for engaging with the positioning edge to prevent movement of the plug member towards the vessel. By means of the hydraulically operated locking pawls, reliable positioning and a strong connection can be achieved.

BRIEF DESCRIPTION OF THE DRAWINGS

Embodiments of the disconnect means according to the invention will be described in detail with reference to the accompanying drawings. In the drawings.

DETAILED DESCRIPTION OF THE INVENTION

Figure 1:
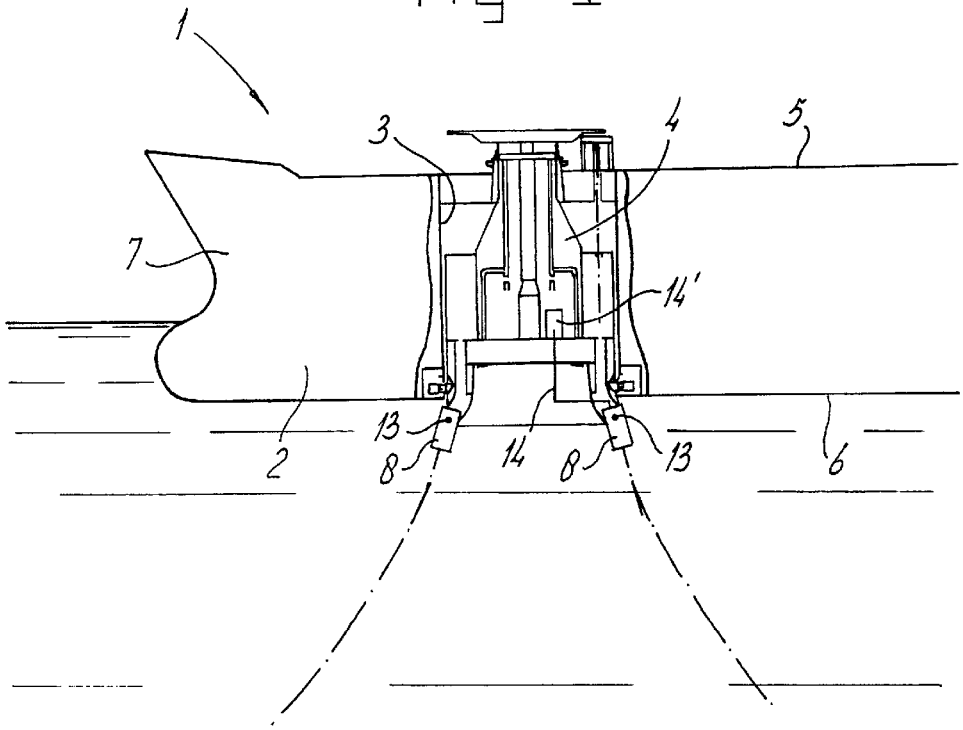
FIG. 1 shows a schematic, partly cross sectional view of a vessel comprising a detachable riser buoy and disconnect means in a disconnected state.
Figure 1:
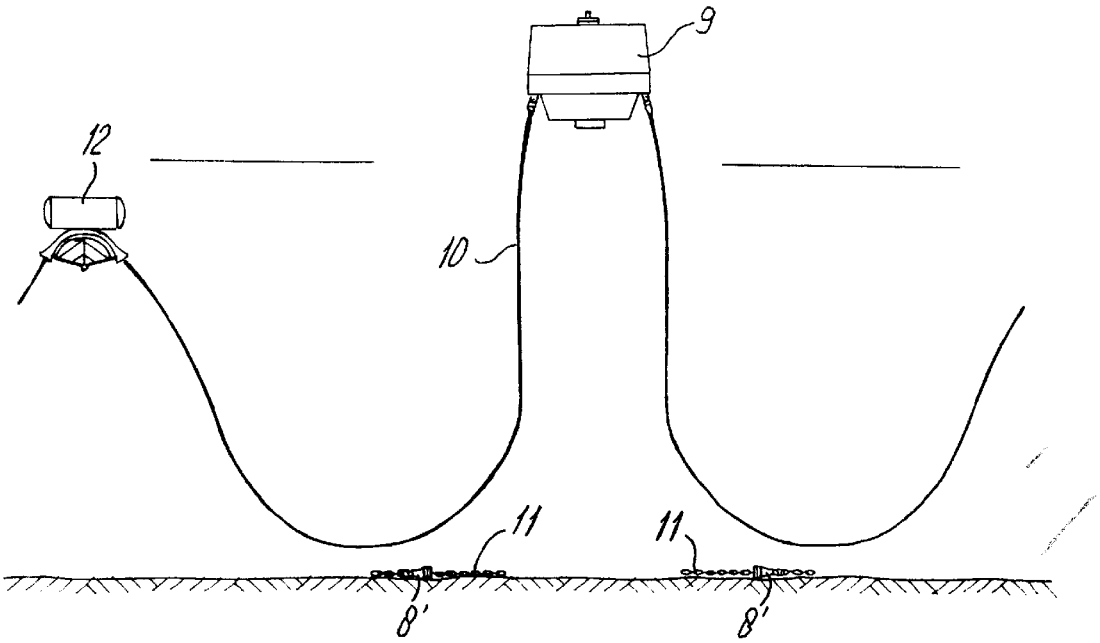

In FIG. 1 a vessel 1 is shown which near its bow 7 is provided with a turret well 3. The turret well 3 is formed by a cylindrical opening in the hull extending from deck level 5 to keel level 6 below the water line. In the turret well 3, a geostationary turret 4 is mounted such that the vessel 1 can weathervane around the turret 4. Flexible risers 10 from an oil well in the sea bed, are supported by submerged buoys 12, and are connected to a riser supporting buoy 9. The riser supporting buoy 9, which in FIG. 1 is shown in the decoupled position, is releasably attached to the lower end of the turret 4. The vessel 1 is anchored to the sea bed by means of anchor lines 11 which comprise at their free ends a second part 8" of a disconnect means which releasably engages with a first part 8 of the disconnect means that is attached to the bottom of the turret 4. In FIG. 1, the parts 8 and 8' of the disconnect means are decoupled, such that the anchor lines 11 are located on the seabed.

The first parts 8 of the disconnect means are hinginly attached to the bottom of the turret 4, in hingepoints 13. The first parts 8 comprise a sleeve in which the plug 8' at the free end of the anchor lines 11 can be inserted. The outer surface of the plug 8' comprises coupling means, such as a number of teeth or projections, which can engage with the teeth or projections on the inner surface of sleeve 8. The projections of the sleeve 8 may be mechanically, hydraulically or electrically movable between a coupling position and a decoupling position. A release control means 14, such as a electrical cable or an hydraulic line, is connected to the sleeve 8 and is on the other side connected to a control unit 14' on the vessel for activating the disconnect means 8,8'.

Figure 2:
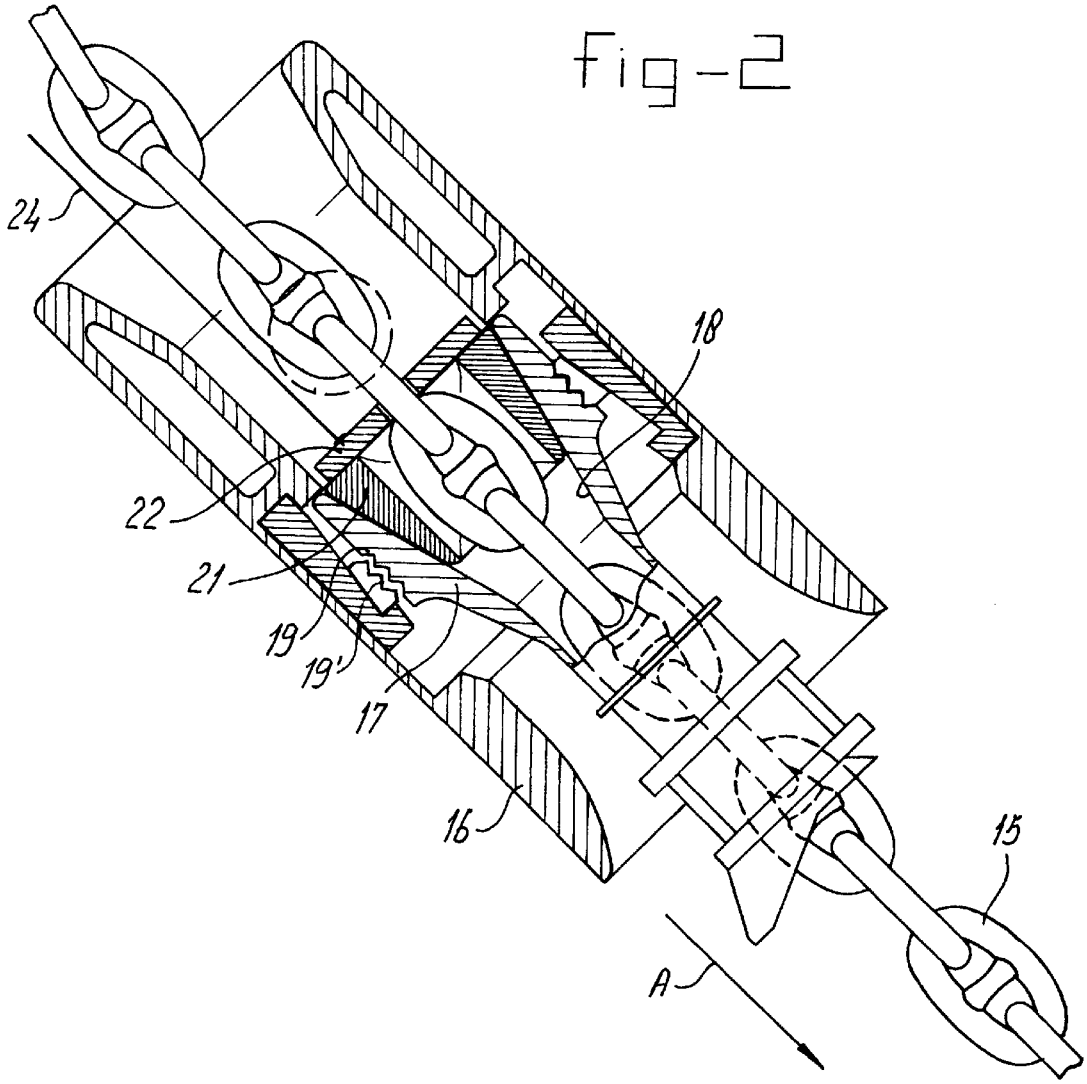
FIG. 2 shows an embodiment of disconnect means attached to the anchor chains of the vessel, comprising a chain stopper.
Figure 3:
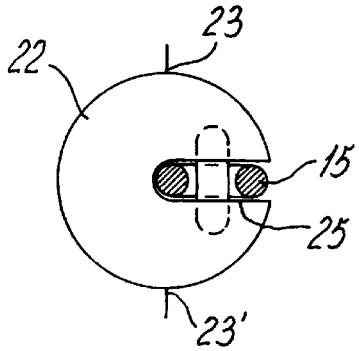
FIG. 3 shows a top view of the chain stopper of FIG. 2, and FIGS. 4 and 5 respectively show a side view of the disconnect means having four hydraulically actuated locking pawls in a connecte and in a disconnected position.

In FIG. 2 a disconnect means is shown wherein the first part comprises a sleeve, or "hawser house" 16 and the second part of the disconnect means comprises a hollow plug member 17. The plug member 17 has an internal tapering wall 18 and is on an external surface provided with teeth 19. A chain 15 is guided through the hollow plug member 18 to a winch on the vessel, which is not shown in the figure. A chain stopper 21 is connected to the plug member 17 and has a stopper plate 22. The stopper plate 22 is hinginly attached to the plug member 17 in hinge points 23, 23' as can be seen in FIG. 3, and covers the opening of the plug member. A cable 24 is connected to the stopper plate 22, such that by pulling the cable 24, the stopper plate can be hinged into a position substantially along the length direction of the chain. When the stopper plate 22 is lifted from the plug member 17, the chain 15 can be let out in the direction of the arrow A. When the chain 15 is pulled towards the vessel, the stopper plate 22 allows the chain elements that are located parallel to the slit 25 in the plate to pass. The chain elements that are perpendicular to the slit 25, will be able to be pulled towards the vessel by hinging the plate 22 upwardly around hinge points 23. Movement of the anchor chain 15 away from the vessel is blocked by the plate 22.

Figure 4:
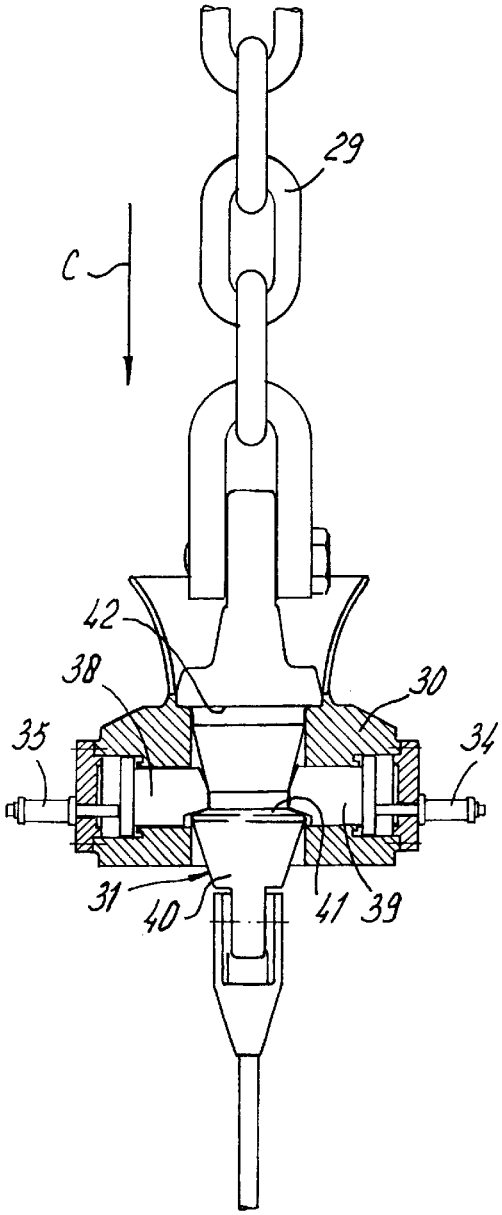
Figure 5:
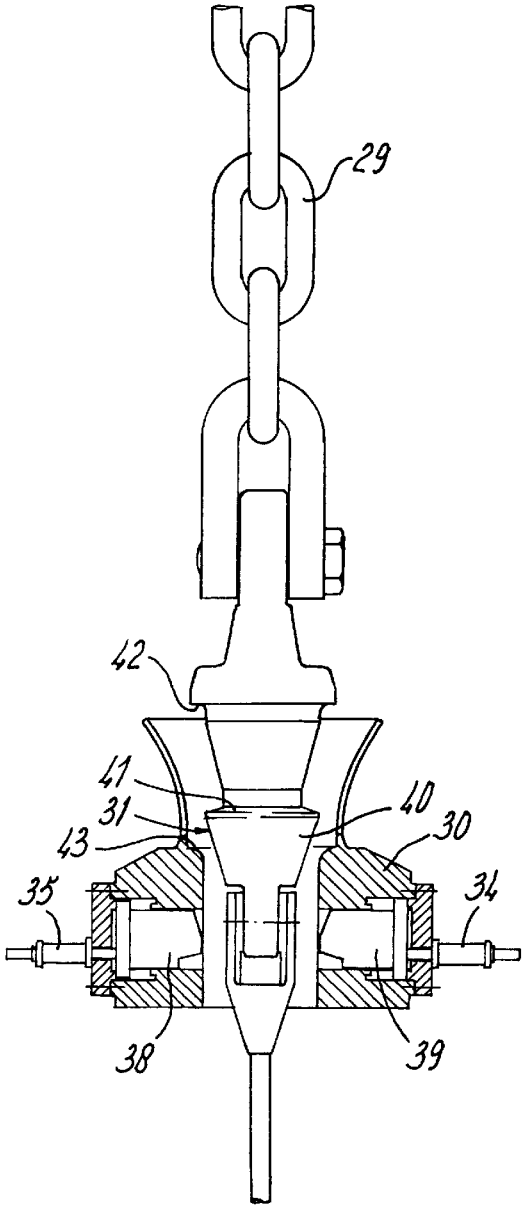

FIGS. 4 and 5 show an embodiment of a disconnect means wherein the first part comprises a generally ring-shaped housing 30, comprising four hydraulic cylinders 34,35. The housing 30 is hinginly attached to the vessel, preferably to the bottom of the turret 4, via bushings, that are not shown in the drawing. Each hydraulic cylinder 34,35 is at its end attached to a locking pawl 38,39 which engage with the plug 31. The plug 31 carries at its lower end an anchor line and is inserted into the housing 30 in the direction of the arrow C.

As can be seen in FIGS. 4 and 5, the plug 31 comprises a conical front part 40 having a locking shoulder 41. A lower positioning edge 42 can engage with a rounded shoulder 43 of the housing 30. The locking pawl 39 can engage the locking shoulder 41 by being displaced in a direction transverse to the centre line of the plug 31. Upon insertion of the plug 31 into the housing 30, the positioning edge 42 abuts against the rounded shoulder 43 to prevent further movement of the plug 31 towards the vessel. A plurality of ring shaped housings may be distributed on the vessel, such as for instance sixteen or twenty housings, in a circular configuration along the bottom of the turret.

We claim:

1. Vessel comprising a plurality of anchor lines or groups of anchor lines, for connecting the vessel to a sea bed;

a plurality of disconnect means releasably attaching the anchor lines to the vessel; each anchor line or group of anchor lines comprising a respective, independently operatable disconnect means; each disconnect means comprising a first part attached directly to the vessel near keel level and a second part attached to the anchor lines; a release control means attached to each disconnect means and being on and operable from a control unit on the vessel, for releasing the first and second parts of each disconnect means;

wherein each disconnect means comprises a hollow housing attached to the vessel, and a plug connected to a corresponding anchor line, said plug having on an external surface first coupling means for engaging with second coupling means on an internal coupling surface of the housing, the distance between the first and second coupling means being variable; and the housing having at its side facing the vessel an opening via which the anchor line passes into the vessel.

2. Vessel according to claim 1, wherein each disconnect means is hingingly attached to the vessel.

3. Vessel according to claim 1, wherein the plug comprises a hollow member, one of the anchor lines running through said hollow member and being connected to a winch on the vessel.

4. Vessel according to claim 3, wherein the hollow member comprises a blocking mechanism allowing movement of the anchor line through the hollow member towards the vessel and blocking movement of the anchor line away from the vessel.

5. Vessel according to claim 4, wherein the anchor line comprises a chain, the blocking mechanism comprising a stopper plate which covers an opening of the hollow member and is hingingly attached to the plug, the stopper plate having a slit through which first chain elements of the anchor line can freely pass and by which second chain elements of the anchor line, that are oriented substantially transverse to the first chain elements are blocked.

6. Vessel according to claim 1, wherein the plug comprises a conical front part having a locking shoulder and a lower positioning edge, the housing comprising at least one locking pawl which is engageable with the locking shoulder of the conical front part, and a receiving rim for engaging with the positioning edge to prevent movement of the plug towards the vessel.

7. Disconnect mean comprising in a vessel, comprising a first part for attaching to the vessel and a second part for attaching to an anchor line, the first part comprising a hollow housing which is adapted to be attached to the vessel near keel level, the second part comprising a plug which is adapted to be attached to an anchor line and which can be inserted into the housing through a receiving opening; the plug having on an external surface first coupling means for engaging second coupling means on an internal coupling surface of the housing, the distance between the first coupling means and the second coupling means being variable by operation of a release control means, the housing having at its side opposite the receiving opening an opening via which the anchor line can extend out of the housing.

* * * * *